United States Patent [19]

Betts et al.

[11] Patent Number: 4,896,609

[45] Date of Patent: Jan. 30, 1990

[54] PLANAR SHOCK WAVE GENERATOR AND ENHANCER DEVICE

[75] Inventors: Robert E. Betts, Huntsville; Lawrence B. Thorn, Madison; William F. Meagher, Huntsville, all of Ala.

[73] Assignee: United States of America as represented by the Secretary of the Army, Washington, D.C.

[21] Appl. No.: 348,753

[22] Filed: May 1, 1989

[51] Int. Cl.[4] ..... F42B 1/02

[52] U.S. Cl. ..... 102/309; 102/307; 102/310; 102/476; 102/505

[58] Field of Search ..... 102/307, 309, 310, 976, 102/505

[56] References Cited

U.S. PATENT DOCUMENTS

| | | | |
|---|---|---|---|
| 3,738,875 | 6/1973 | Bucklishch | 102/309 |
| 3,802,342 | 4/1974 | Berlot et al. | 102/309 |
| 4,594,947 | 6/1986 | Aubry et al. | 102/309 X |
| 4,672,896 | 6/1987 | Precoul et al. | 102/309 |
| 4,711,181 | 12/1987 | Ringel et al. | 102/309 X |
| 4,724,767 | 2/1988 | Aseltine | 102/309 X |
| 4,829,901 | 5/1989 | Yates, Jr. | 102/309 X |

*Primary Examiner*—Peter A. Nelson

*Attorney, Agent, or Firm*—Freddie M. Bush; James T. Deaton

[57] ABSTRACT

An explosive planar shock wave generator produces a planar wave that travels down a shape charge cone to give amplified force on the jet. In all embodiments radial waves are converted to planar waves which react with an explosive shape charge. A planar wave shaper is comprised of a conically shaped planar charge having a predetermined diameter at the base and slant heights terminating at an apex. A cylindrically shaped fast detonating charge which is positioned above the cone shaped planar charge is detonated by a detonator positioned on the surface of the cylindrically shaped fast detonating charge. A sloweer cone shaped detonating shape charge intersecting along the base of the conically shaped planar charge receive the planar shock wave as transformed by the conically shaped planar charge. An additional explosive charge which has intersecting surfaces with the faster cylindrically shaped detonating charge and the slower cone shaped detonating shape charge functions to direct the resultant shock wave inward at a perpendicular angle to the cone angles of the slower cone shaped detonating shape charge. This function results in a faster closing of the intersecting surfaces to yield a higher jet velocity directred along the center of the cone. Another embodiment provides for a shape of a slower cone shaped detonating shape charge to converge to an apex beneath the base of the conically shaped planar charge. The additional explosive charge for this embodiment results in directing the resultant shock wave inward at a more perpendicular angle which causes the intersecting surfaces to close at even a higher rate. This high closing rate results in a higher jet velocity and more efficiency to permit a reduction in overall weight, length, and diameter of the shape charge to achieve the same effect. If a greater resultant force is needed a larger diameter can be employed without an increase in length which is advantageous where lengths restriction to a warhead is a factor.

4 Claims, 2 Drawing Sheets

PLANAR SHOCK WAVE GENERATOR AND ENHANCER DEVICE

DEDICATORY CLAUSE

The invention described herein may be manufactured, used, and licensed by or for the Government for governmental purposes without the payment to us of any royalties thereon.

BACKGROUND OF THE INVENTION

Earlier evaluations of propellants which contained predominately ammonium perchlorate and rubber indicated large failure diameters. Thus, testing sufficiently large sized propellant diameters at full scale proved to be very expensive, and although major testing was completed in the mid-sixties under a program "Standard Propellant Hazards" (SOPHY), which was termed the failure diameter project to end all propellant failure diameter testing, the SOPHY predictions have been applied and used to good purpose for many similar propellant formulations even to present times.

More recently, the methods of further characterizing explosives and other energetic materials such as propellant comprise applying a shock wave to the material under investigation by means of a known explosive charge. This is typically done by providing a donor explosive in the form of a cylinder or cone which is placed on top of an acceptor which is the material being investigated. Attenuators such as cards (plastics or paper) or water is sometimes placed between the donor and acceptor to quantify the succeptability of the acceptor. For example, an explosive pellet of tetryl (donor) is exploded against a sample of a rocket propellant (acceptor) with 1/16 inch cards or discs of plexiglas in between. If the propellant detonates with 50 cards in between but does not detonate with 60 cards in between then it is more sensitive to detonation than a propellant which will detonate at 30 cards but does not detonate at 40 cards.

The need for very small testing has been indicated by not only economic considerations but environmental impact and restrictions against polutants. As a result, acceptable test methods which employ only small quantities, such as one pint of an experimental mix, have been developed which predict failure diameters that are comparable with failure diameters based on SOPHY estimates. The fringe benefits which result from developed technology have generally resulted from further exploitation of some concepts encountered during the development of new technology. For example, the generation of a planar shock wave to impact with a right circular cylinder of explosive was involved with failure diameter determinations of explosive in small scale amounts.

It is now the object of this invention to employ planar shock wave technology to achieve a new result.

Therefore, an object of this invention is to provide a planar wave generator for producing a planar wave that travels down a shape charge cone to give amplified force on the jet.

SUMMARY OF THE INVENTION

A planar wave shaper converts a radial wave generated from a first initiated explosive charge to a planar wave and subsequently directs the explosive force toward a conical shape charge. In one embodiment the width of the planar wave is equal to the diameter of the explosive which is in contact with the outer diameter of the cone. Since the shock wave traveling down the cone is planar, the resultant explosive force on the cone is greater towards the cone center where the jet is being formed. Therefore, the combination of a detonator charge positioned on the surface of a fast detonating explosive charge of a predetermined diameter which intersects with an intermediate cone shaped planar charge of a slower detonating charge and having the same diameter of the fast burning charge achieves a reduction of the amount of explosives needed above the cone of a shape charge which results in reduced weight, length, and diameter of the shape charge to get the same effect.

Another embodiment is the combination of a detonator charge positioned on the surface of a fast detonating charge of a predetermied diameter which intersects with a cone shaped planar charge having the same predetermined diameter as the shape charge with which it also intersects. An additional charge having the predetermined diameter of the fast detonating charge which intersects with surface of the fast detonating charge and which intersects and extends along the surface of the shape charge is a faster detonating charge than the cone shaped planar charge and is also a faster detonating charge than the shape charge. The effect of this embodiment is to cause the intersection of the cone angle to close at a higher velocity than from a radial or planar wave alone. The faster explosive is initiating the slower explosive along their intersecting surfaces. This causes the resultant shock wave to be directed inward at a more perpendicular angle which causes the intersecting surfaces to close at a higher rate. Since the close rate is higher, the jet velocity is higher. The resultant force may be less, in which case an increase in overall diameter may be required, but not an increase in length.

DESCRIPTION OF THE PREFERRED EMBODIMENT

A planar wave generator produces a planar wave that travels down a conically shaped charge to give amplified force on a jet formed down the centerline of cone.

Figure 1:
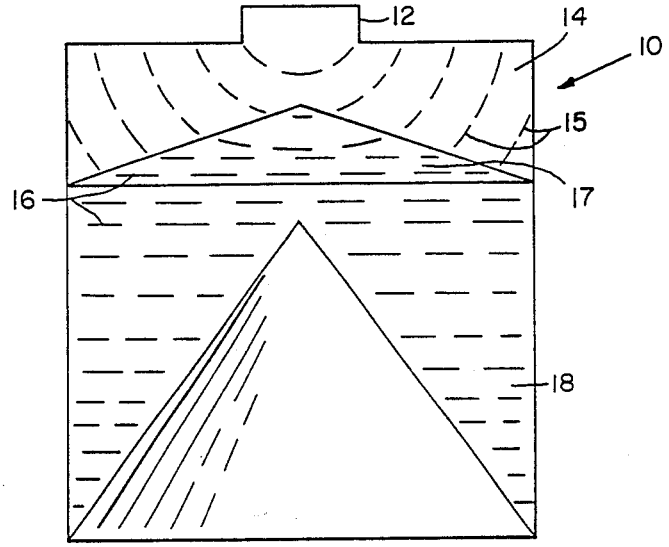
FIG. 1 depicts a sectional view of an improved grenade employing a planar wave shapes for converting a radial wave to a planar wave in accordance with this invention.

In further reference to the Figures of the Drawing, FIG. 1 illustrates an improved grenade 10 with a detonator 12 centered over a conically shaped charge. An explosive charge 14 receives a radial shock wave 15 from the detonator 12 which radial shock wave is subsequently acted upon by a conically shaped planar charge 17 which converts the radial shock wave 15 to a planar waves 16 which acts upon conically shaped charge 18 to achieve an explosive force on the cone which is greater towards the cone center where the jet is being formed. The width of the planar wave in this example is equal to the diameter of the explosive which is in contact with the outer diameter of the cone. Since the wave traveling down the cone is planar, the resultant explosive force on the cone is greater towards the cone center where the jet is being formed. The greater the diameter of a standard cone shaped charge the more explosive is needed above the cone to reduce the loss from a radial shock wave. A rule of thumb has been that the length of explosive should be about three times its diameter to reduce the radial effects. Therefore, the larger the diameter of a shape charge the more efficient the planar wave becomes when compared to a point source radial wave. An optimum design shape charge of this type would be one in which the planar charge has a lower detonation (DET) velocity with respect to the charge above it. Therefore, using the planar wave shaper above the cone reduces the amount of explosives needed above the cone which also reduces weight, length, and diameter of a shape charge to get the same effect.

Figure 2:
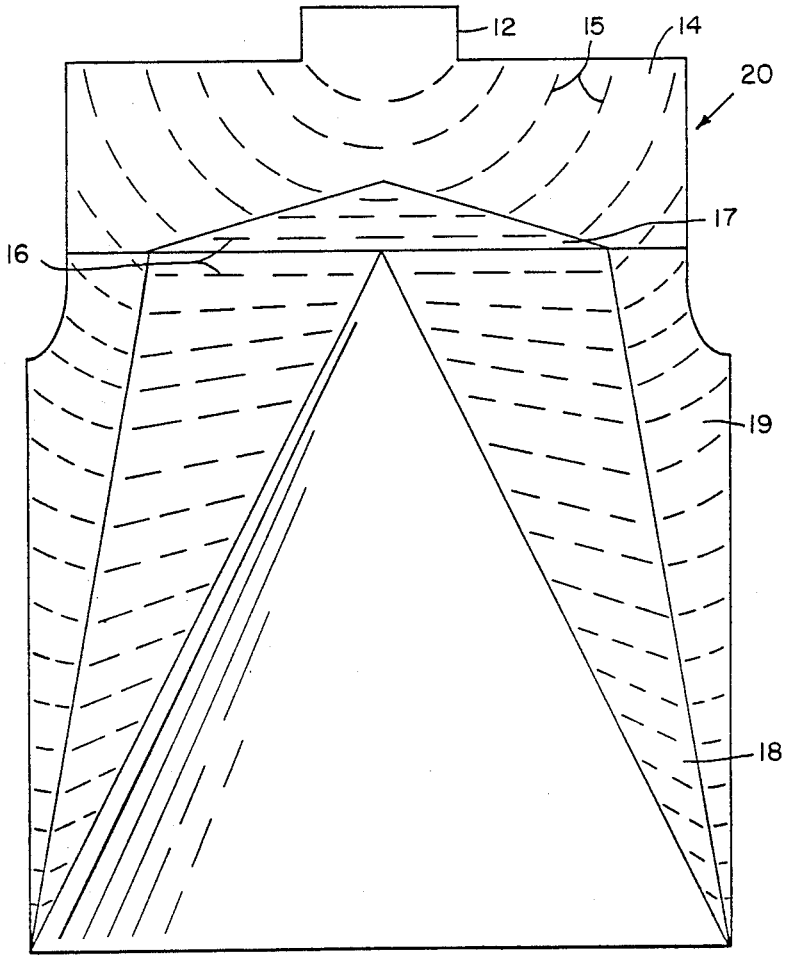
FIG. 2 depicts a sectional view of an enhancer device employing a planar wave shaper for converting a radial wave to a planar wave, and includes an additional explosive charge for directing the resultant shock waves inward at a perpendicular angle to the cone angle of shape charge to cause the intersecting surfaces to close at a higher rate yielding a higher jet velocity towards the cone center.

FIG. 2 depicts an enhancer device 20 wherein similar functioning parts as, illustrated in FIG. 1, are assigned the same numerals. Thus, enhancer device 20 comprises a faster detonator charges 14, a slower planar charge 17 which intersects with detonator shape charge 18 which also intersects with a faster detonator charge 19. The base of planar charge 17 has the same diameter as detonator charge 18, and detonator charge 14 has a larger diameter than detonator charge 18. Charge 19 has the same diameter as charge 14 but increases in diameter along intersection lines along detonator charge 18. Thus, the radial shock wave from explosive charge 14 is acted upon by planar charge 17 to convert radial waves 15 to planar waves 16 which reacts with explosive charge 18. Since explosive charge 19 is faster than explosive charge 18 resultant force on cone is greater than if explosive charge 19 were all explosive charge 18. The additional charge 19 causes the intersection of the cone angle to close at a higher velocity than from a radial or planar wave alone resulting from only the combination of charges 14, 17, and 18. The faster explosive charge 14 achieves initiating action for the slower explosive charges 17, 18, and 19 along their intersecting surfaces; however, it is charge 19 which promotes the closing of the cone angle along intersection lines at a faster rate.

Figure 3:
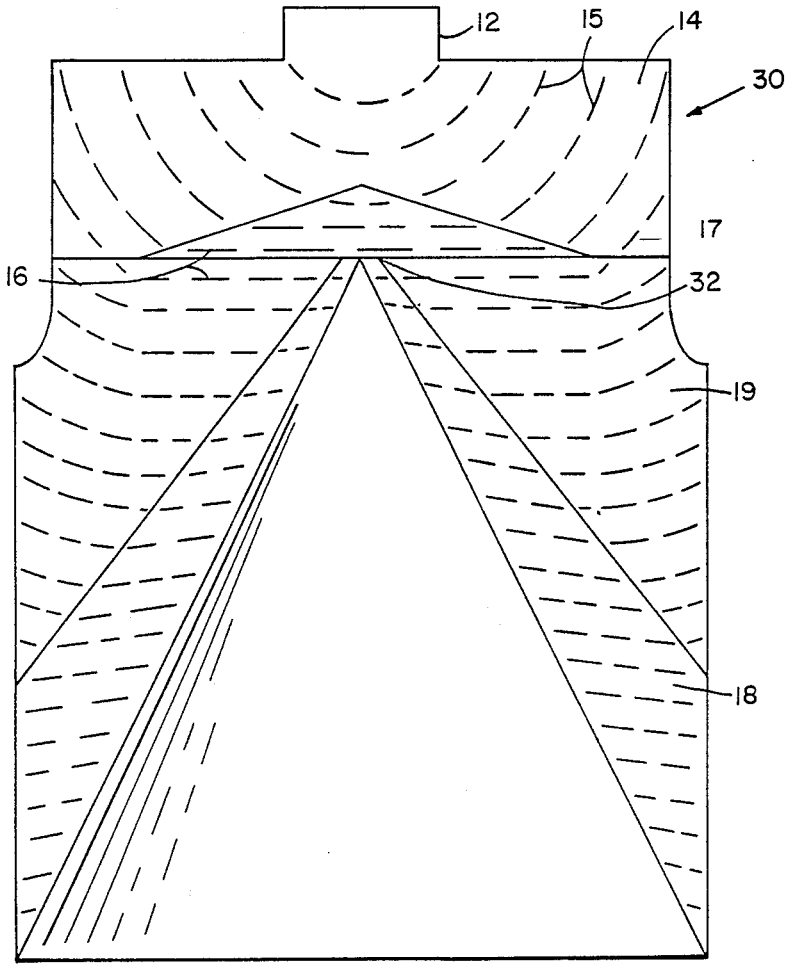
FIG. 3 depicts another embodiment similar to FIG. 2 embodiment but FIG. 3 illustrates an arrangement of detonating charge to produce a shock wave directed more towards the cone center to cause the intersecting surfaces to close at even a higher rate yielding an even higher jet velocity.

FIG. 3 depicts an enhancer device 30 wherein similar functioning parts, as illustrated in FIGS. 1 and 2, are assigned the same numerals; however, the base of planar charge 17 has a smaller diameter than detonator charges 14 and 19, but detonator charge 18 has its apex portion 32 which intersects with a smaller portion of the base portion of conically shaped planar charge 17 as compared to embodiment of FIG. 2. Thus, the transformation of radial shock waves 15 to resultant planar shock waves 16, causes more interaction with faster detonator charge 19, but the interaction with slower detonator charge 18 increases due to the cone shaped apex 32 so that the net results are that planar shock waves are directed more toward center where the jet is formed to thereby cause an even faster closing rate for the embodiment depicted in FIG. 3 to take place as compared with the embodiment depicted in FIG. 2 due to the ratio of detonating velocities which are $14>17<19>18$.

In summary, the faster explosive or detonating charge is initiating the slower explosive or detonating charge along their intersecting surfaces. As previously stated hereinabove, this causes the resultant shock wave to be directed inward at a more perpendicular angle which also causes the intersecting surfaces to close at a higher rate. Thus, a higher closing rate results in a higher jet velocity. The resultant total force may be less, in which case an increase in overall diameter may be required, but not an increase in length. Where a shorter warhead is required because of space limitation on board a missile, this could work to an another advantage for the missile system which employs the enhancer device of this invention.

The outer housing for containing the planar shock wave generator and detonator enhancer device is not shown since the performances of the device are based on the structural arrangement and the detonating ratio of the functional elements without restrictive limitations imposed by the outer housing. The outer housing can be selected in accordance with the intended field of use such as in a grenade, on board a missile, or in an armor penetrating round.

We claim:

1. A planar shock wave generator and detonator enhancer device which permits a reduction in weight, length, and diameter of a shape charge to achieve the same effect with which said device functions, said planar shock wave generator and detonator enhancer device comprising:

(i) a planar wave shaper which transforms radial shock waves generated from a first initiated explosive to planar waves and directs said planar waves toward a shape charge, said planar wave shaper comprising:

(a) a conically shaped planar charge having a predetermined diameter at the base and slant heights terminating at an apex;

(b) a cylindrically shaped fast detonating charge positoned above said conically shaped planar charge and intersecting along said slant heights of said conically shaped planar charge; and, (c) a detonator positioned on the surface of said cylindrically shaped fast detonating charge to provide initiation point on surface which generates radial shock waves which are acted upon by said conically shaped planar charge to transform said radial waves to planar shock waves;

(ii) a slower cone shaped detonating shape charge intersecting along the base of said conically shaped planar charge for receiving said planar shock waves as transformed by said conically planar charge, said planar shock waves traveling down said slower cone shaped detonating shape charge to achieve detonation and to give amplified explosive force on the jet towards the cone center resulting from said detonation, said amplified explosive force resulting from said planar wave shaper transformation permitting a reduction in weight, length, and diameter of said shape charge to achieve the same effect.

2. The planar shock wave generator and detonator enhancer device as defined in claim 1 wherein said predetermined diameter at the base of said conically shaped planar charge is equal to diameter of said cylindrically shaped fast detonating charge and said slower cone shaped detonating charge along intersecting lines along said base and along intersecting lines of said slant heights of said conically shaped planar charge.

3. The planar shock wave generator and detonator device as defined in claim 1 and additionally comprising an additional explosive charge for directing the resultant shock waves inward at a more perpendicular angle to the cone angle of said slower cone shaped detonating shape charge, said additional explosive charge intersecting with said fast cylindrically shaped detonating charge and said slower cone shaped detonating shape charge, said additional explosive charge being a faster detonating charge than said slower cone shaped detonating shape charge, and wherein said predetermined diameter at the base of said conically shaped planar charge is smaller than said cylindrically shaped fast detonating charge which has a larger diameter and which intersects along the base line of said conically shaped planar charge with said additional faster detonating charge of equal diameter at said base line of intersection, said additional faster detonating charge having an increasing diameter along the intersecting lines with said slower cone shaped detonating shape charge, said additional faster detonating charge initiating said slower cone shaped detonating shape charge along their intersecting surfaces to cause the resultant shock wave to be directed inward at a more perpendicular angle which causes the intersecting surfaces to close at a higher rate to yield a higher jet velocity.

4. The planar shock wave generator and detonator device as defined in claim 1 and additionally comprising an additional explosive charge for directing the resultant shock waves inward at a more perpendicular angle to the cone angle of said slower cone shaped detonating shape charge, said additional explosive charge intersecting with said fast cylindrically shaped detonating charge, said slower cone shaped detonating shape charge, and said slower conically shaped planar charge, and wherein said predetermined diameter at the base of said conically shaped planar charge is smaller than said cylindrically shaped fast detonating charge which has a larger diameter which intersects along the base line of said conically shaped planar charge with said additional faster detonating charge of equal diameter at said base line of intersection, said additional faster detonating charge having an increasing diameter along the intersecting lines with said slower cone shaped detonating shape charge, said additional faster detonating charge terminating at a point along said intersecting line from which said point to slant height of said slower cone shaped detonating shape charge converges to an epex at the base of said conically shaped planar charge and said cone shaped detonating shape charge extending past said point to complete a cone angle below said conically shaped planar charge, said additional explosive charge initiating said slower cone shaped detonating shape charge along their intersecting surfaces to cause the resultant shock wave to be directed inward at a more perpendicular angle which causes the intersecting surfaces to close at a very high rate to yield a much higher jet velocity directed along the center of the cone of said cone shaped detonating shape charge.

* * * * *